US006990789B2

(12) United States Patent
Riccardi

(10) Patent No.: US 6,990,789 B2
(45) Date of Patent: Jan. 31, 2006

(54) ADJUSTABLE STRIPPER BLADE/ MOISTENER SYSTEM FOR A MAILING SYSTEM

(75) Inventor: Victor C. Riccardi, Stamford, CT (US)

(73) Assignee: Pitney Bowes Inc., Stamford, CT (US)

( * ) Notice: Subject to any disclaimer, the term of this patent is extended or adjusted under 35 U.S.C. 154(b) by 106 days.

(21) Appl. No.: 10/324,995

(22) Filed: Dec. 20, 2002

(65) Prior Publication Data

US 2004/0118089 A1 Jun. 24, 2004

(51) Int. Cl.
*B67B 7/00* (2006.01)

(52) U.S. Cl. ..... 53/492; 53/381.5; 53/381.7; 53/569

(58) Field of Classification Search ..... 53/569, 53/284.4, 492, 70, 381.2, 381.3, 381.5, 381.7; 493/309

See application file for complete search history.

(56) References Cited

U.S. PATENT DOCUMENTS

| | | | | |
|---|---|---|---|---|
| 3,747,297 A | * | 7/1973 | Hankins | 53/381.7 |
| 4,924,106 A | | 5/1990 | Tolmie, Jr. | |
| 5,007,371 A | | 4/1991 | O'Dea et al. | |
| 5,020,473 A | | 6/1991 | Bergman | |
| 5,098,734 A | | 3/1992 | O'Dea et al. | |
| 5,145,709 A | | 9/1992 | Bergman | |
| 5,327,705 A | | 7/1994 | DeFigueiredo | |
| 5,598,686 A | * | 2/1997 | Owen | 53/492 |
| 5,660,030 A | * | 8/1997 | Auerbach et al. | 53/569 |
| 5,729,954 A | * | 3/1998 | Lines et al. | 53/381.7 |
| 6,406,591 B1 | | 6/2002 | Beckstrom et al. | |

* cited by examiner

*Primary Examiner*—Rinaldi I. Rada
*Assistant Examiner*—John Paradiso
(74) *Attorney, Agent, or Firm*—Brian A. Lemm; Angelo N. Chaclas

(57) ABSTRACT

An adjustable stripper/moistener system for a mailing system is provided. The stripper blade and moistening assembly are adjustable in a direction transverse to the movement of a mail piece being passed through the mailing machine. By allowing the stripper blade to move with respect to the feed deck, the position of the stripper blade can be optimally set to reliably strip different size and shape flaps from different types of envelopes. Additionally, by allowing the moistening assembly to move in conjunction with the stripper blade, there is better control of the amount and location of deposition of the moistening fluid on the envelope flap, thereby preventing possible damage to the envelope or its contents. The position of the stripper blade and moistening assembly may be manually adjustable by an operator, or automatically adjusted based on an input or sensed profile of the envelope flap.

8 Claims, 5 Drawing Sheets

ADJUSTABLE STRIPPER BLADE/ MOISTENER SYSTEM FOR A MAILING SYSTEM

FIELD OF THE INVENTION

The invention disclosed herein relates generally to mailing systems, and more particularly to an adjustable stripper blade/moistener system for stripping and moistening an envelope flap of an envelope being processed by the mailing machine.

BACKGROUND OF THE INVENTION

Mailing systems, such as, for example, a mailing machine, often include different modules that automate the processes of producing mail pieces. The typical mailing machine includes a variety of different modules or subsystems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a stripping/moistening module, i.e., stripping open the flap of an envelope, wetting and sealing the glued flap of an envelope, a weighing module, and a metering/printing module, i.e., applying evidence of postage to the mail piece. The exact configuration of the mailing machine is, of course, particular to the needs of the user.

The stripping/moistening module includes a structure for deflecting a flap of a moving envelope away from the envelope's body to enable the moistening and sealing process to occur. The deflecting structure typically includes a stripper blade that becomes inserted between the flap of the envelope and the body of the envelope as the envelope traverses the transport deck of the mailing machine. Once the flap has been stripped, the moistening device moistens the glue line on the flap in preparation for sealing the envelope. One type of moistening system, known as a contact moistening system, generally deposits a moistening fluid, such as, for example, water or water with a biocide, onto the glue line on a flap of an envelope by contacting the glue line with a wetted applicator.

In contact systems, the wetted applicator typically consists of a contact media such as a brush, foam or felt. The applicator is in physical contact with a wick. The wick is generally a woven material, such as, for example, felt, or can also be a foam material. At least a portion of the wick is located in a reservoir containing the moistening fluid. The moistening fluid is transferred from the wick to the applicator by physical contact pressure between the wick and applicator, thereby wetting the applicator. A stripped envelope flap is guided between the wick and applicator, such that the applicator contacts the glue line on the flap of the envelope, thereby transferring the moistening fluid to the flap to activate the glue. The flap is then closed and sealed, such as, for example, by passing the closed envelope through a nip of a sealer roller to compress the envelope and flap together, and the envelope passed to the next module for continued processing.

There are problems, however, with conventional stripping/moistening modules as described above. For example, the position of the stripper blade/moistening device is generally fixed within the mailing machine. The position of the stripper blade/moistening device in relation to the flap of the envelope directly impacts the reliability of the functions performed. Envelopes are increasingly available in a variety of sizes, which makes it difficult to design into a mailing machine optimum interaction between an envelope and the stripper blade. For example, there are several sizes of commercial business envelopes and baronial envelopes available. For commercial business envelopes, a #10 envelope has dimensions of 4⅛ inches by 9½ inches, a #11 envelope has dimensions of 4½ inches by 10½ inches, a #7 envelope has dimensions of 3⅝ inches by 6½ inches, and a #6¼ envelope has dimensions of 3½ inches by 6 inches. For baronial envelopes, a #4 envelope has dimensions of 3⅝ inches by 5⅛ inches, and a #5 envelope has dimensions of 4⅛ inches by 5½ inches. Other types of envelopes, such as, for example, a square envelope, may have dimensions of 5 inches by 5 inches, 6 inches by 6 inches, or 8 inches by 8 inches. Multiple other sizes and dimensions of envelopes are also available. In addition, envelopes can have differently shaped flaps, such as commercial style, monarch style or square style, and the different shapes can each be provided in different sizes.

The stripper blade/moistening module is fixedly set in one position within the mailing machine to reliably strip and moisten standard commercial business envelopes, and specifically #10 envelopes, as they are most commonly used. This creates problems, however, for other envelopes of different size or with different shaped flaps. For example, the stripper blade in this position may experience problems stripping square flaps, due to the width of the flap. In addition, even when the square flap is properly stripped open, the moistening device will moisten the entire width of the flap, and not just the glue line, since the entire flap must pass over the moistening device due to the position of the moistening device. Moistening the entire flap can cause moistening of the contents of the envelope as well, which could damage the contents. Excessive moistening can also negatively impact any printing performed on the envelope, such as, for example, a postage indicium. For example, if the printing is being done by an ink-jet printer, an excessive amount of moisture will cause the ink to run, thereby possibly rendering any printed information illegible.

Thus, there exists a need for a stripper blade/moistener system that can better accommodate envelopes of different sizes having different shaped and sized flaps.

SUMMARY OF THE INVENTION

The present invention alleviates the problems associated with the prior art and provides a stripper blade/moistening system that can reliably strip and seal envelopes of different sizes having flaps of different shapes and sizes. The present invention provides an adjustable stripper blade and moistening assembly that can be set based on the envelope size or flap size. The adjustable system of the present invention provides better control over the stripping of the envelope flap, as well as the placement of moistening fluid deposited on an envelope flap, thereby ensuring more consistent stripping and sealing, while also reducing the likelihood of an over-wetting condition.

In accordance with the present invention, a stripper blade and moistening assembly are adjustable in a direction transverse to the movement of a mail piece being passed through the mailing machine. By allowing the stripper blade to move with respect to the feed deck, the position of the stripper blade can be optimally set to reliably strip different size envelopes having flaps of different shapes and sizes. Additionally, by allowing the moistening assembly to move in conjunction with the stripper blade, there is better control of the amount and location of deposition of the moistening fluid on the envelope flap, thereby preventing possible damage to the envelope or its contents. In accordance with one embodiment of the present invention, the position of the stripper blade and moistening assembly are manually adjustable by an operator. In accordance with another embodiment, the position of the stripper blade and moistening assembly are automatically adjusted based on an input or, alternatively, sensed profile of the envelope flap.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
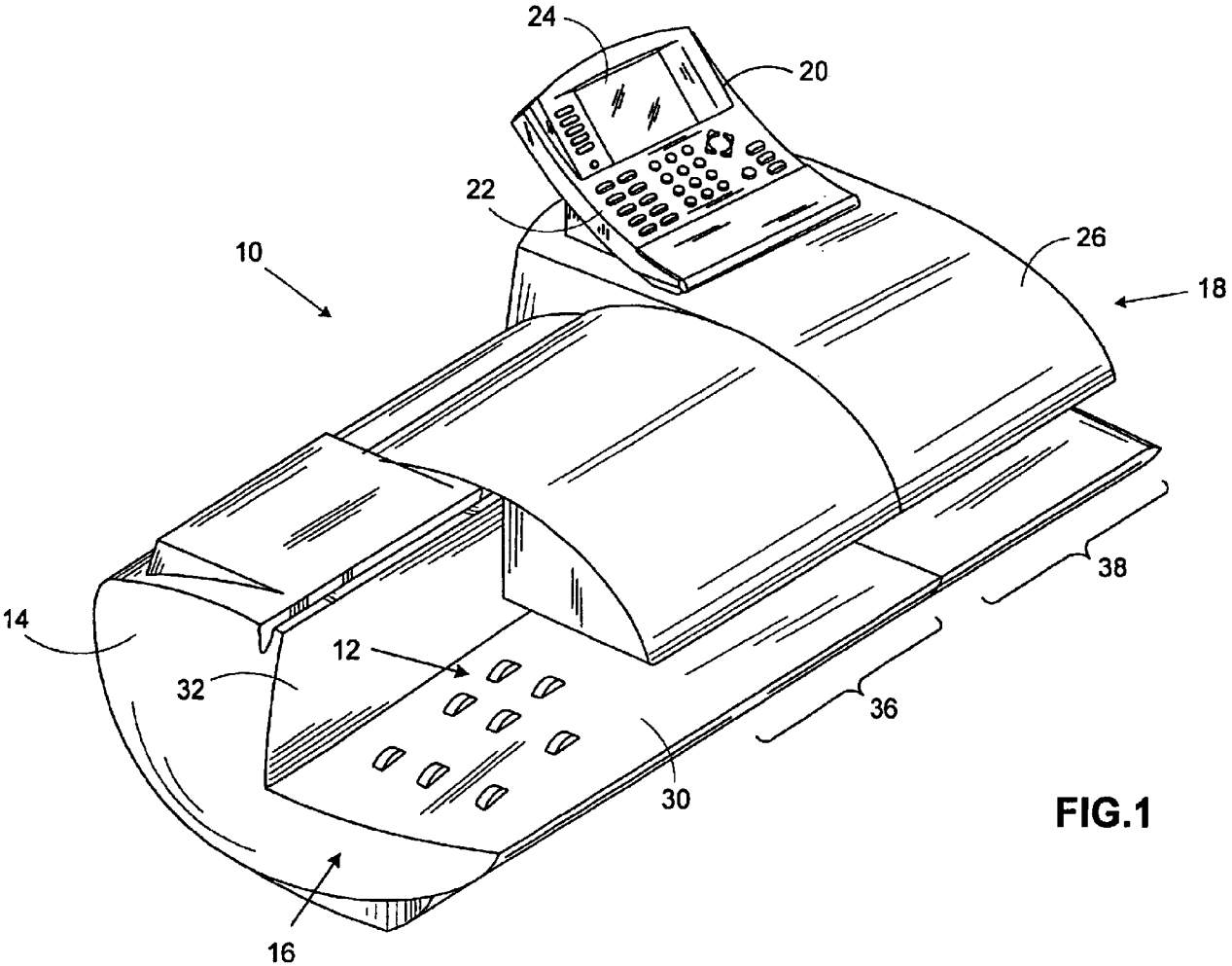
FIG. 1 illustrates a mailing machine including an adjustable stripper/moistener system according to the present invention.

In describing the present invention, reference is made to the drawings, wherein there is seen in FIG. 1 a mailing machine 10 that includes an adjustable stripper/moistener system according to the present invention. Mailing machine 10 comprises a base unit, designated generally by the reference numeral 14, the base unit 14 having a mail piece input end, designated generally by the reference numeral 16 and a mail piece output end, designated generally by the reference numeral 18. A control unit 20 is mounted on the base unit 14, and includes one or more input/output devices, such as, for example, a keyboard 22 and a display device 24. One or more cover members 26 are pivotally mounted on the base 14 so as to move from the closed position shown in FIG. 1 to an open position (not shown) to expose various operating components and parts for service and/or repair as needed.

The base unit 14 further includes a horizontal feed deck 30 which extends substantially from the input end 16 to the output end 18. A plurality of nudger rollers 12 are suitably mounted under the feed deck 30 and project upwardly through openings in the feed deck so that the periphery of the rollers 12 is slightly above the upper surface of the feed deck 30 and can exert a forward feeding force on a succession of mail pieces placed in the input end 16. A registration wall 32 defines a mail piece registration surface substantially perpendicular to the feed deck 30 that extends substantially from the input end 16 to the output end 18. Mail pieces placed in the input end 16 are fed by the nudger rollers 12 along the feed deck 30, with the top edge of the mail piece being registered against the wall 32. The mail pieces may be passed through one or more modules, such as, for example, a singulator module and an adjustable stripper/moistening module according to the present invention as described below. Each of these modules is located generally in the area indicated by reference numeral 36. The mail pieces are then passed to a metering/printing module located generally in the area indicated by reference numeral 38.

Figure 2:
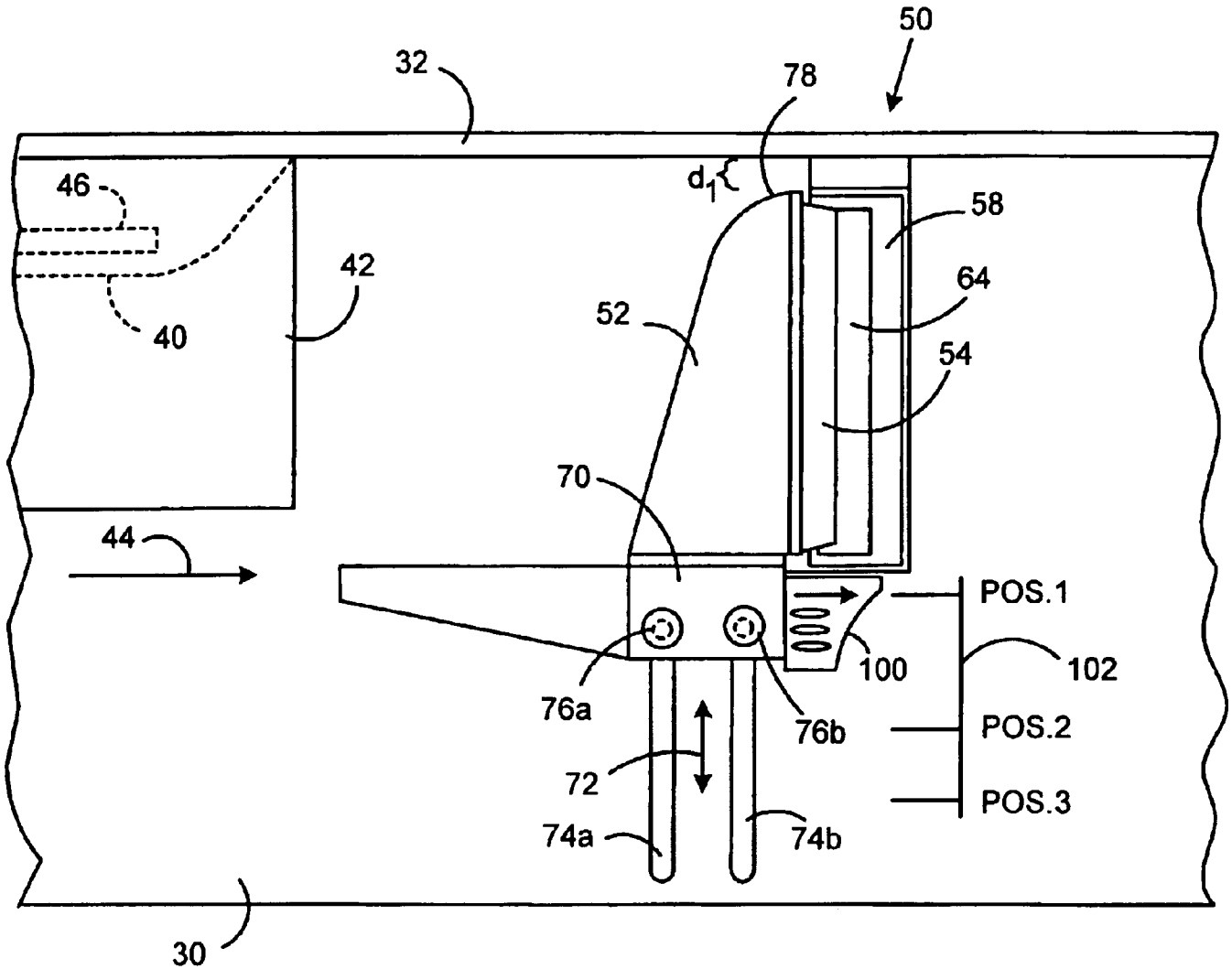
FIG. 2 illustrates a top view of the adjustable stripper/moistener system according to the present invention in a first position.
Figure 3:
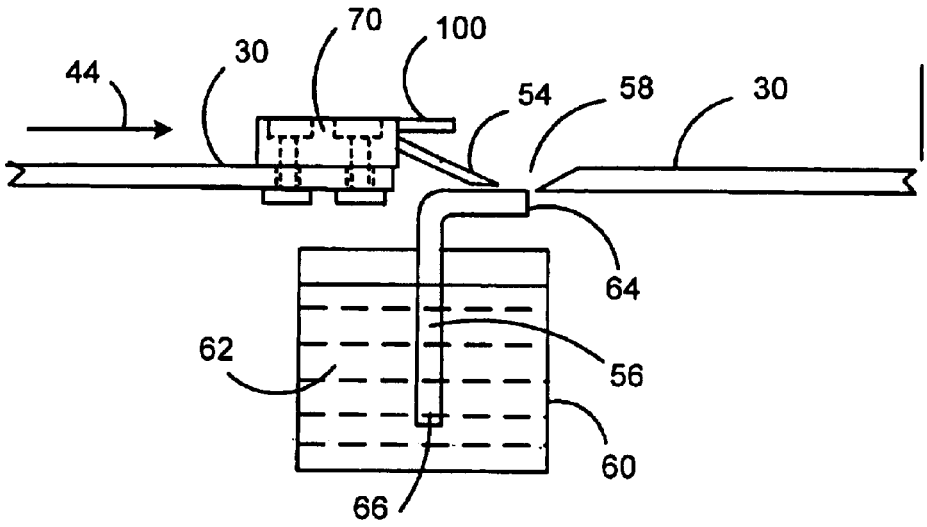
FIG. 3 illustrates a side view the adjustable stripper/moistener system according to the present invention.

Referring now to FIGS. 2 and 3, there is illustrated a top view and a side view, respectively, of an adjustable stripping/moistening system 50 according to the present inventions. Stripping/moistening system 50 could be used, for example to process a mail piece being transported through the mailing machine 10 of FIG. 1, and would be located near the registration wall 32 along the feed deck 30 generally in the area designated 36. System 50 may also be mounted in other types of mailing systems, such as, for example, an inserter.

System 50 includes a stripping blade 52 positioned to strip a flap 40 of an envelope 42 from the envelope 42 as the envelope 42 traverses the feed deck 30 in the direction indicated by arrow 44. The envelope 42 is situated on the feed deck 30 face up, i.e., the back of the envelope, with the flap 40, faces the feed deck 30. Flap 40 includes a glue line 46. As the envelope 42 is transported along the feed deck 30, it is guided onto the stripper blade 52 such that the flap 40 will pass between a gap between the stripper blade 52 and feed deck 30 while the body of the envelope 42 will pass over the top of the stripper blade 52. Thus, the flap 40 is stripped from the envelope 42 by the stripper blade 52.

An applicator assembly 54 is coupled to the stripper blade 52. Applicator assembly 54 includes a contact media, such as, for example, a brush, foam or felt. The applicator assembly 54 is located above a wick 56. Wick 56 is preferably formed of a woven material, and has a first end portion 66 disposed in a reservoir 60 located beneath the feed deck 30 (FIG. 3). The reservoir 60 contains a moistening fluid 62, such as, for example, water or water with a biocide, for moistening the glue line 46 on the flap 40 of envelope 42. Wick 56 includes a second end portion 64 situated near an opening 58 in the feed deck 30 such that the applicator assembly 54 and the second end portion 64 of the wick 56 make contact with each other through the opening 58. The wick 56 wicks moistening fluid 62 from the reservoir 60 from the first end 66 to the second end 64. Moistening fluid 62 is then transferred from the second end portion 64 of the wick 56 to the applicator assembly 54. As noted above, the body of the envelope 42 will pass over the top of the stripper blade, and hence the applicator assembly 54, while the flap 40 will pass under the stripper blade 52 and thus between the applicator assembly 54 and portion 64 of the wick 56. Moistening fluid 62 will thus be transferred from the applicator assembly 54 to the glue line 46 of flap 40. The second end portion 64 of wick 56 is preferably located slightly below the level of the feed deck 30, thereby minimizing any contact between the end portion 64 of wick 56 and the outside of the flap 40 of envelope 42.

Referring again to FIG. 2, the stripper blade 52 is mounted to a chassis 70. FIG. 2 illustrates the chassis 70 in a first position, in which the top edge 78 of the stripper blade 52 is located a distance $d_1$ from the registration wall 32. The stripping action is most reliable when the bottom edge of the envelope flap 40 is close to the top edge 78 of the stripper blade 52. While this position may be suitable for reliably stripping and moistening certain sizes of envelopes, such as, for example, #10 envelopes, it may not be as reliable for other size envelopes or envelopes with different flap styles. For example, a large square flap, which extends much further toward the chassis 70, may be difficult to strip open, due to the location of the top edge 78 of the stripping blade 52 with respect to the bottom edge of the flap. To overcome these deficiencies, according to the present invention, chassis 70 is movable in a direction transverse to the direction in which the envelope 42 travels as indicated by arrow 72. In accordance with one embodiment of the present invention, movement of chassis 70 is facilitated by a pair of channels 74*a,* 74*b* in the feed deck 30. Support rods 76*a,* 76*b,* coupled to the chassis 70, extend through the channels 74*a,* 74*b* such that the rods 76*a,* 76*b* can move from one end to the other of the channels 74*a,* 74*b*. It should be understood, of course, that movement of the chassis 70 can be facilitated in any manner, such as, for example, tracks in which the chassis 70 slides, a single channel, or any other type of mechanism that allows the chassis 70 to move back and forth. A tab 100, coupled to the chassis 70, may be provided to allow an operator to manually slide the chassis 70 back and forth in the direction of arrow 72. A position indicator, such as for example, a line graph 102, can optionally be provided to indicate the position of the stripper/moistener system 50.

Figure 4:
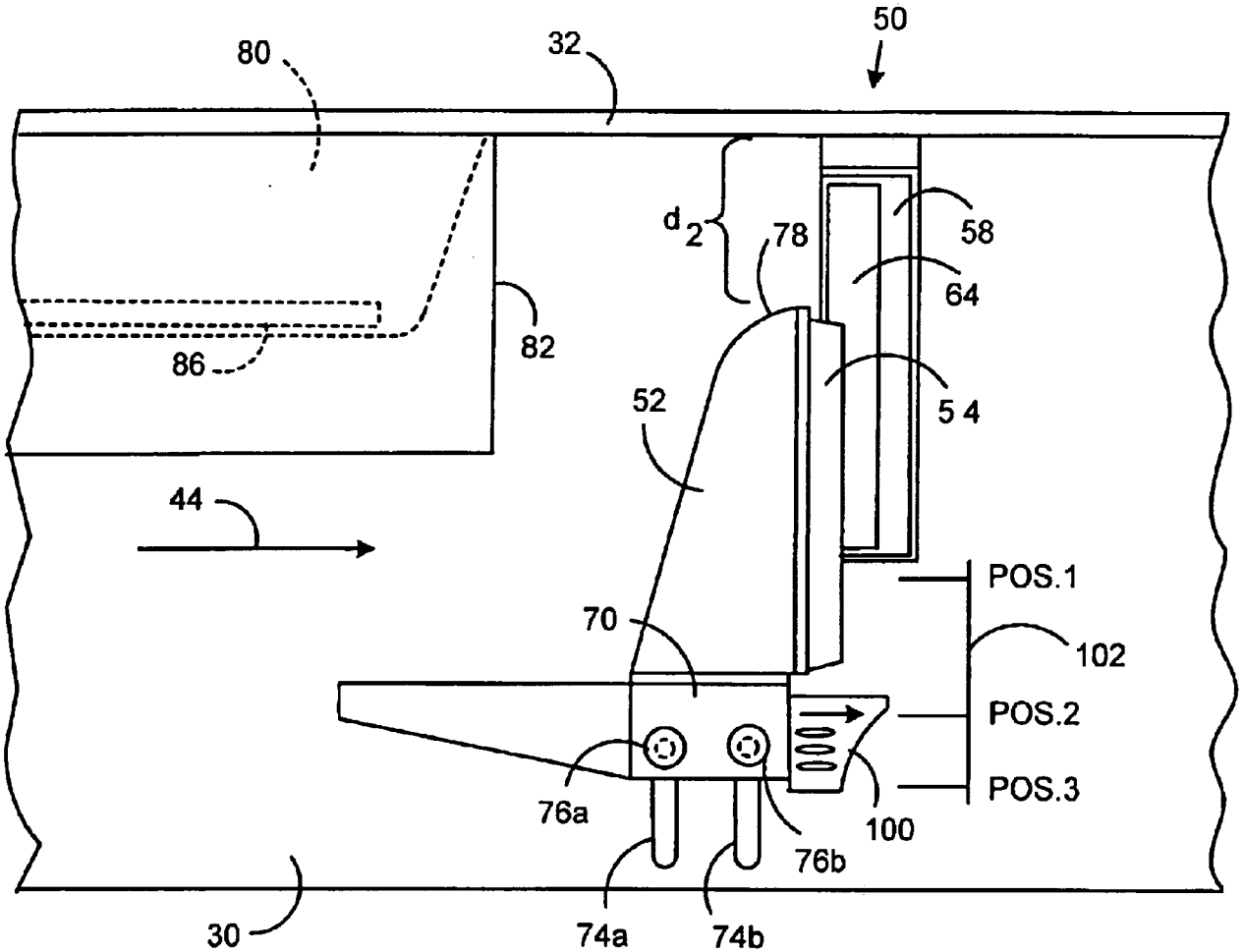
FIG. 4 illustrates a top view of the adjustable stripper/moistener system according to the present invention in a second position.

FIG. 4 illustrates a top view of the adjustable stripper/moistener system 50 according to the present invention in a second position in which the top edge 78 of the stripper blade 52 is located a distance $d_2$ from the registration wall 32. With the top edge 78 of the stripper blade 52 located a distance $d_2$ from the registration wall 32, an envelope with a large flap, such as the flap 80 of envelope 82, can be reliably stripped, since the top edge 78 of the stripper blade 52 is positioned near the bottom edge of the flap 80. Additionally, the adjustable stripper/moistening system 50 of the present invention provides better control of the application of the moistening fluid 62. This is accomplished by reducing the area of the flap 80 that will be moistened by the applicator assembly 54. Since the applicator assembly 54 is coupled to the stripper blade 52, it will also move when the chassis 70 is moved. Thus, only the portion of the flap 80 that contains the glue line 86 will pass beneath the applicator assembly 54, and not the entire flap 80 as would occur if the stripper blade/moistener system 50 were left in the first position as illustrated in FIG. 2. This prevents excessive moistening of the flap 80, thereby preventing possible damage to the contents of envelope 82 or any negative impact on any printing performed on the envelope 82.

Better control of the application of the moistening fluid 62, according to the present invention, also has other advantages. For example, the amount of moistening fluid is also better controlled by reducing the area of the flap 80 that contacts the applicator assembly 54. This prevents the applicator assembly 54 from being depleted of moistening fluid 62 by not wasting the moistening fluid 62 on portions of the flap 80 where it is not desired or needed. The recovery time for the applicator assembly 54, i.e., the time required between mail pieces for the applicator assembly 54 to have sufficient amount of moistening fluid 62 transferred to it from the wick 56, is significantly decreased, as only the tip of the applicator assembly 54 (near blade edge 78) is being used. It is especially important to have a short recovery period for mailing machines that process mail pieces at a fast rate, such as, for example, 150 letters per minute.

Figure 5:
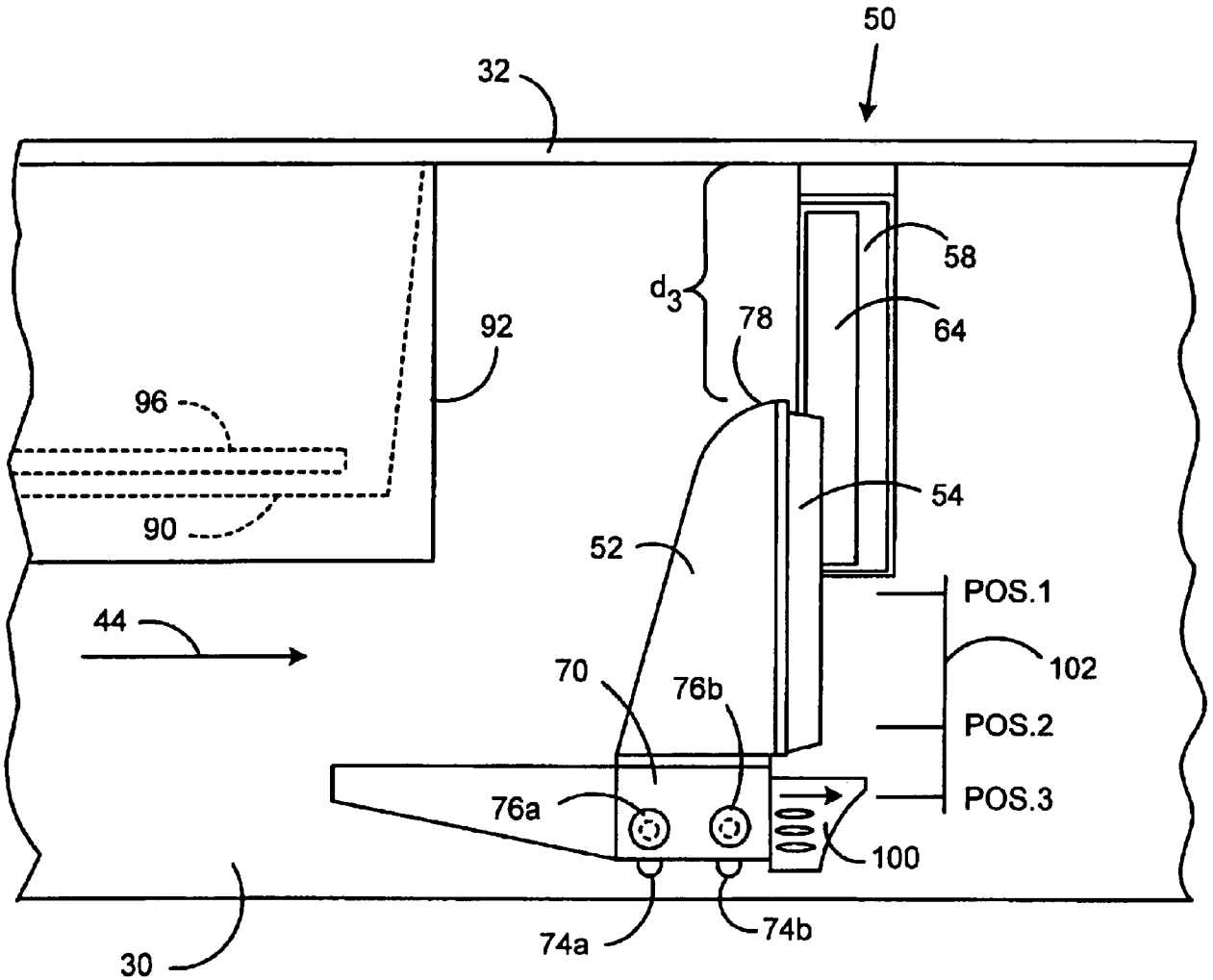
FIG. 5 illustrates a top view of the adjustable stripper/moistener system according to the present invention in a third position.

FIG. 5 illustrates a top view of the adjustable stripper/moistener system 50 according to the present invention in a third position in which the top edge 78 of the stripper blade 52 is located a distance $d_3$ from the registration wall 32. With the top edge 78 of the stripper blade 52 located a distance $d_3$ from the registration wall 32, a large envelope with a square flap, such as the flap 90 of envelope 92, can be reliably stripped, since the top edge 78 of the stripper blade 52 is positioned near the bottom edge of the flap 90. Additionally, the area of the flap 90 that will be moistened by the applicator assembly 54 is reduced to a minimal amount that contains the glue line 96 similarly as described above. This prevents excessive moistening of the flap 90, thereby preventing possible damage to the contents of envelope 92 or any negative impact on any printing performed on the envelope 92.

Thus, according to the present invention, an adjustable stripper blade/moistening system 50 is provided that provides more reliable stripping of different sized envelopes and envelope flaps, as well as better control of the placement of moistening fluid on an envelope flap. It should be understood that while the above description included three different positions for the stripper/moistener system 50, the invention is not so limited and can be provided with any number of positions according to the intended application of the mailing machine 10. The position of the stripper/moistener system 50 can be manually adjusted by the operator based on the size of the envelope or flap style. Optionally, a reference guide or measurement guide could be printed on the feed deck 30 that provides an index of different flap styles and the optimal position setting of the stripper/moistener system 50 for the envelope flap style the operator is utilizing. Alternatively, the reference guide could be provided in a user's manual or the like.

Figure 6:
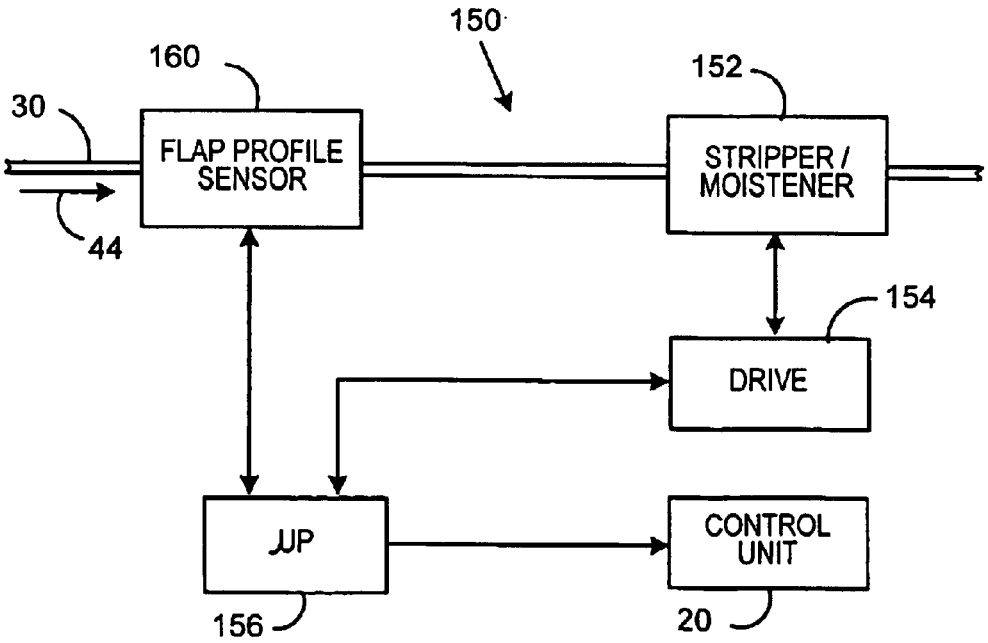
FIG. 6 illustrate in block diagram form an adjustable stripper/moistener system according to another embodiment of the present invention.

Referring now to FIG. 6, there is illustrated in block diagram form an adjustable stripper/moistener system 150 according to another embodiment of the present invention. System 150 includes a stripper/moistener 152 that has similar mechanical features to stripper/moistener 50 as described with respect to FIGS. 2 and 3. Stripper/moistener 152 is coupled to a drive 154, such as, for example, a motor, that moves the stripper/moistener 152 in a direction transverse to the feed deck 30. Drive 154 can utilize a belt, screw, gears or any other type of system to move the stripper/moistener 152 back and forth perpendicular to the feed deck 30 to different positions similarly as described in FIGS. 2–5. The drive 154 is controlled by a processor 156. Processor 156 is coupled to the control unit 20 of the mailing machine 10. Thus, an operator can input the flap style and/or envelope size, utilizing the keyboard 22 and/or display 24 of control unit 20, that the operator will be feeding through the mailing machine 10. The processor 156, in response to the input from the operator, will determine to optimal position for the stripper/moistener 152 and activate the drive 154 to move the stripper/moistener 152 to the determined optimal position for reliably stripping the envelopes being processed, and preventing any over-wetting conditions from occurring as described above.

Optionally, a flap profile sensor 160 could be provided along the feed deck 30 upstream from the stripper/moistener 152. The flap profile sensor 160 could be similar to the apparatus as described in U.S. Pat. No. 4,924,106, which is hereby incorporated by reference. As an envelope moves in the direction indicated by arrow 44, it will pass the envelope profile sensor 160 which provides information to the processor with respect to the profile of the flap of the envelope. The processor 156 can then automatically determine the optimal position for reliably stripping the envelope based on the profile as sensed by the sensor 160, and will automatically activate the drive 154 to move the stripper/moistener 152 to the determined optimal position for reliably stripping the envelope being processed and preventing any overwetting conditions from occurring as described above. Thus, the processing of mixed mail, i.e., mail pieces of varying sizes, can be automatically accomplished without the need for the operator to have to change the position of the stripper/moistener system for each separate mail piece.

Thus, according to the present invention, an adjustable stripper blade/moistening system is provided that provides more reliable stripping of different sized envelopes and envelope flaps, as well as better control of the placement of moistening fluid on an envelope flap. Those skilled in the art will also recognize that various modifications can be made without departing from the spirit of the present invention. For example, the construction of applicator assembly 54 can vary. A traditional "wick to contact medium" style, as described above, can be used. Alternatively, a wick could be attached to the stripper blade and hang into a supply of moistening fluid. The wick then also acts as the contact medium to transfer the moistening fluid to the glue line of the envelope flap. As another example, the stripper blade and reservoir could be one integral piece, with the wick being part of the stripper blade and moistening fluid being supplied from within the stripper blade. The supply of moistening fluid within the stripper blade could be maintained by pumping moistening fluid from a remote tank.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. In a mailing machine having a feed deck along which an envelope having an envelope body and an envelope flap is fed in a first direction along a path of travel, a registration wall located substantially perpendicular to the feed deck and parallel to the path of travel and along which a top edge of the envelope is aligned during feeding of the envelope through the mailing machine, and a stripper blade including a top edge, the stripper blade being mounted to a chassis coupled to a support rod passing through a channel in the feed deck, the channel extending along the feed deck in a direction transverse to the first direction, a method for separating the envelope flap from the envelope body comprising:

determining a distance between a bottom edge of the envelope flap and the registration wall as the envelope is fed along the path of travel;

determining a desired distance between the top edge of the stripper blade and the registration wall, the desired distance being based on the distance between the bottom edge of the envelope flap and the registration wall such that the top edge of the stripper blade will be positioned near the bottom edge of the envelope flap;

automatically moving the chassis in response to an input from an operator by sliding the support rod in the channel in a direction transverse to the first direction such that the distance between the top edge of the stripper blade and the registration wall is approximately the desired distance; and separating the envelope flap from the envelope body using the stripper blade.

2. The method of claim 1, wherein determining the desired distance further comprises:

using a reference guide to determine the desired distance.

3. The method according to claim 1, wherein determining the desired distance further comprises:

automatically sensing a profile of the envelope flap; and determining the desired distance based on the sensed profile of the envelope flap.

4. A mailing machine comprising:

a base including a feed deck along which an envelope having an envelope body, an envelope flap and a top edge is fed in a first direction along a path of travel;

a registration wall located substantially perpendicular to the feed deck and parallel to the path of travel and along which the envelope top edge is aligned during feeding of the envelope through the mailing machine;

a stripper blade including a top edge, the stripper blade being mounted to a chassis coupled to a support rod passing through a channel in the feed deck, the channel extending along the feed deck in a direction transverse to the first direction, the chassis being moveable with respect to the feed deck by sliding the support rod in the channel such that the top edge of the stripper blade can move between at least a first position in which the top edge of the stripper blade is a first distance from the registration wall and a second position in which the top edge of the stripper blade is a second distance from the registration wall;

a drive device coupled to the chassis to move the chassis;

a processor coupled to the drive device; and a flap profile sensor coupled to the processor to determine a profile of the envelope flap, wherein the processor automatically causes the drive device to move the chassis such that the top edge of the stripper blade is positioned in either the first or second position based on a size of the envelope flap and the determined profile of the envelope flap such that the top edge of the stripper blade is located near a bottom edge of the envelope flap to separate the envelope flap from the envelope body.

5. The mailing machine according to claim 4, wherein the drive device includes a motor.

6. The mailing machine according to claim 4, further comprising:

an input device, wherein the drive device moves the chassis based on an input to the input device from an operator.

7. The mailing machine according to claim 6, wherein the input from an operator includes a flap style of the envelope.

8. The mailing machine according to claim 4, wherein the stripper blade further comprises:

an applicator assembly for applying a moistening fluid to the envelope flap.

* * * * *